US009819082B2

(12) United States Patent
Cherrette et al.

(10) Patent No.: US 9,819,082 B2
(45) Date of Patent: Nov. 14, 2017

(54) HYBRID ELECTRONIC/MECHANICAL SCANNING ARRAY ANTENNA

(71) Applicant: NORTHROP GRUMMAN SYSTEMS CORPORATION, Falls Church, VA (US)

(72) Inventors: Alan Cherrette, Hermosa, CA (US); Richmond D. Bruno, Rancho Palos Verdes, CA (US); Scott Brisbin, Palos Verdes Penninsula, CA (US); Gordon Lok, La Habra, CA (US)

(73) Assignee: Northrop Grumman Systems Corporation, Falls Church, VA (US)

( * ) Notice: Subject to any disclaimer, the term of this patent is extended or adjusted under 35 U.S.C. 154(b) by 646 days.

(21) Appl. No.: 14/531,630

(22) Filed: Nov. 3, 2014

(65) Prior Publication Data

US 2016/0126629 A1 May 5, 2016

(51) Int. Cl.
*H01Q 3/02* (2006.01)
*H01Q 13/10* (2006.01)
(Continued)

(52) U.S. Cl.
CPC ..... *H01Q 3/34* (2013.01); *H01Q 1/02* (2013.01); *H01Q 1/28* (2013.01); *H01Q 3/04* (2013.01);
(Continued)

(58) Field of Classification Search
CPC .. H01Q 1/34; H01Q 3/02; H01Q 3/26; H01Q 3/30; H01Q 13/10; H01Q 21/00; H01Q 23/00; H05K 5/20; F28F 3/02
See application file for complete search history.

(56) References Cited

U.S. PATENT DOCUMENTS 5,128,689 A 7/1992 Wong et al.
5,929,820 A 7/1999 Caulfield et al.
(Continued)

FOREIGN PATENT DOCUMENTS

CN 201717865 U 1/2011
RU 2450388 C1 5/2012

OTHER PUBLICATIONS

Otto, S. et al. "Planar Satcom Antenna Systems in KA-Band" ESA/ESTEC, Noordwijk, The Netherlands, Oct. 3-5, 2012, 5 pgs.
(Continued)

*Primary Examiner* — Blane Jackson
(74) *Attorney, Agent, or Firm* — John A. Miller; Miller IP Group, PLC

(57) ABSTRACT

A hybrid electronic/mechanical scanning array antenna including an outer housing and a cold plate rotatable therein. A waveguide aperture including an array of antenna elements is mounted to a top surface of the cold plate and a multi-layer circuit board is mounted to a bottom surface of the cold plate. A plurality of amplifier modules are mounted to the cold plate, where the circuit board includes a plurality of openings that allow the amplifier modules to be directly mounted to the cold plate, and the cold plate includes a plurality of RF signal channels that allow RF signals from the amplifier modules to travel through the cold plate. The amplifier modules are controlled to provide phase-weighting for electronic signal scanning in an elevation direction and rotation of the cold plate allows signal scanning in an azimuth direction.

20 Claims, 3 Drawing Sheets

(51) Int. Cl.

| | |
|---|---|
| ***H01Q 21/00*** | (2006.01) |
| ***H05K 7/20*** | (2006.01) |
| ***F28F 9/013*** | (2006.01) |
| ***H01Q 3/34*** | (2006.01) |
| ***H01Q 1/28*** | (2006.01) |
| ***H01Q 3/04*** | (2006.01) |
| ***H01Q 1/02*** | (2006.01) |
| ***H01Q 3/26*** | (2006.01) |
| ***H01Q 21/06*** | (2006.01) |

(52) U.S. Cl.
CPC ..... *H01Q 3/26* (2013.01); *H01Q 21/0006* (2013.01); *H01Q 21/064* (2013.01)

(56) References Cited

U.S. PATENT DOCUMENTS

| | | | | |
|---|---|---|---|---|
| 6,081,235 | A | 6/2000 | Romanofsky et al. | |
| 6,184,832 | B1 | 2/2001 | Geyh et al. | |
| 6,297,774 | B1 | 10/2001 | Chung | |
| 7,009,570 | B2 | 3/2006 | Durham et al. | |
| 7,109,937 | B2 | 9/2006 | Iluz et al. | |
| 7,161,537 | B2 | 1/2007 | Rafi et al. | |
| 7,564,420 | B2 | 7/2009 | Jeon et al. | |
| 7,911,400 | B2 * | 3/2011 | Kaplan | H01Q 1/125 343/713 |
| 8,519,890 | B2 | 8/2013 | Huang et al. | |
| 8,570,237 | B2 | 10/2013 | Brown et al. | |
| 8,587,492 | B2 | 11/2013 | Runyon | |
| 9,019,166 | B2 * | 4/2015 | Puzella | H01Q 1/02 343/700 MS |
| 9,701,939 | B2 * | 7/2017 | Newby | C12N 5/0068 |
| 2002/0050946 | A1 | 5/2002 | Chang et al. | |
| 2002/0167449 | A1 | 11/2002 | Frazita et al. | |
| 2006/0227048 | A1 | 10/2006 | Mak | |
| 2007/0096982 | A1 | 5/2007 | Kalian et al. | |
| 2008/0316139 | A1 | 12/2008 | Blaser et al. | |
| 2009/0315760 | A1 | 12/2009 | Mousavi Bafrooei et al. | |
| 2010/0052994 | A1 | 3/2010 | Llorens del Rio et al. | |
| 2012/0063098 | A1 * | 3/2012 | Paquette | H01L 23/4332 361/721 |
| 2012/0249366 | A1 | 10/2012 | Pozgay et al. | |
| 2012/0287006 | A1 | 11/2012 | Lenormand et al. | |
| 2015/0015453 | A1 * | 1/2015 | Puzella | H01Q 21/0025 343/853 |

OTHER PUBLICATIONS

Zaghloul, A. I. et al. "Low Cost Flat Antennas for Commercial and Military Satcom Terminals" IEEE 2001, pp. 795-799.
Pedersen, J. F. "Measured Antenna Performance of an EHF Hybrid Scan Array Antenna for MIL Satcom Applications" IEEE 1988, pp. 192-195.
Varley, R. F. et al. "EHF Satcom Terminal Antennas" IEEE 1982, pp. 18.1-1-18.1-10.
Kelly, A. J. et al. "The SHF Hybrid Scan Array" IEEE 1981, pp. 187-190.
Shelly, M. W. et al. "Low Profile Scanning Antennas for Satcom "on-the-move"" ERA Technology Ltd, UK, pp. 1-6.

* cited by examiner

HYBRID ELECTRONIC/MECHANICAL SCANNING ARRAY ANTENNA

BACKGROUND

Field

This invention relates generally to a scanning array antenna and, more particularly, to a hybrid scanning array antenna that electrically scans in elevation and mechanically scans in azimuth, where the antenna is compact to be suitable for airborne platform applications.

Discussion

There is a constellation of stationary geosynchronous communications satellites in orbit around the earth that are used for both commercial and military purposes. Adjacent satellites in the constellation are required to be some minimal distance or number of degrees apart so that uplink signals transmitted to a particular satellite in the constellation from ground stations or airborne platforms are not received and do not interfere with the adjacent satellites. In order to accomplish this, the transmission antennas that transmit the uplink signals need to have a beam width on the order of a few degrees and have high gain.

Active phased array narrow beam width antennas that are able to electronically scan in both the azimuth and elevation directions are available in the art for this purpose. Active phased array antennas have good antenna and radar cross-section (RCS) performance, but they are expensive. Further, the cost of active phased array antennas increases proportionally with the aperture size of the antenna. Generally, BLOS or SATCOM antennas require large aperture areas, which result in array antennas with thousands of individually phased-weighted and amplified antenna elements, which significantly increases the cost of the antenna.

For airborne platform satellite communications applications, it is known in the art to provide an antenna dish that is mechanically scanned in both the azimuth and elevation directions using a two-dimensional gimbal. Such dish antennas are typically large in size and are mounted under a radome extending from the aircraft skin. Because the radome extends from the aircraft it creates drag, which reduces fuel efficiency and reduces mission time on station. Additionally, the radome increases the aircraft's RCS, which causes the aircraft to become more visible on radar. Further, dish antennas often have poor aperture efficiency and high side-lobe levels for antennas designed to operate over wide instantaneous bandwidths. Transmit versions of dish antennas often require a high power traveling wave tube amplifier (TWTA) to amplify the transmit signal.

DETAILED DESCRIPTION OF THE EMBODIMENTS

The following discussion of the embodiments of the invention directed to a hybrid electronic/mechanical scanning array antenna is merely exemplary in nature, and is in no way intended to limit the invention or its applications or uses. For example, the discussion below describes the antenna as having particular application for transmission purposes for an airborne platform. However, as will be appreciated by those skilled in the art, the antenna of the invention may have other applications.

Figure 1:
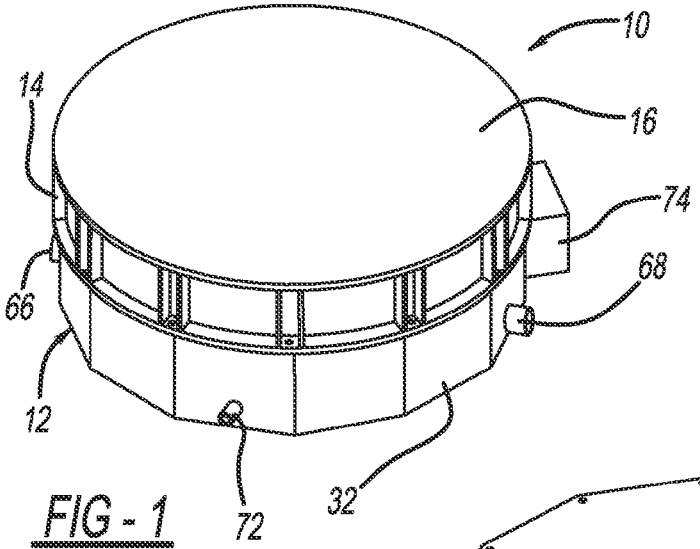
FIG. 1 is a top isometric view of a hybrid electronic/mechanical scanning array antenna.
Figure 2:
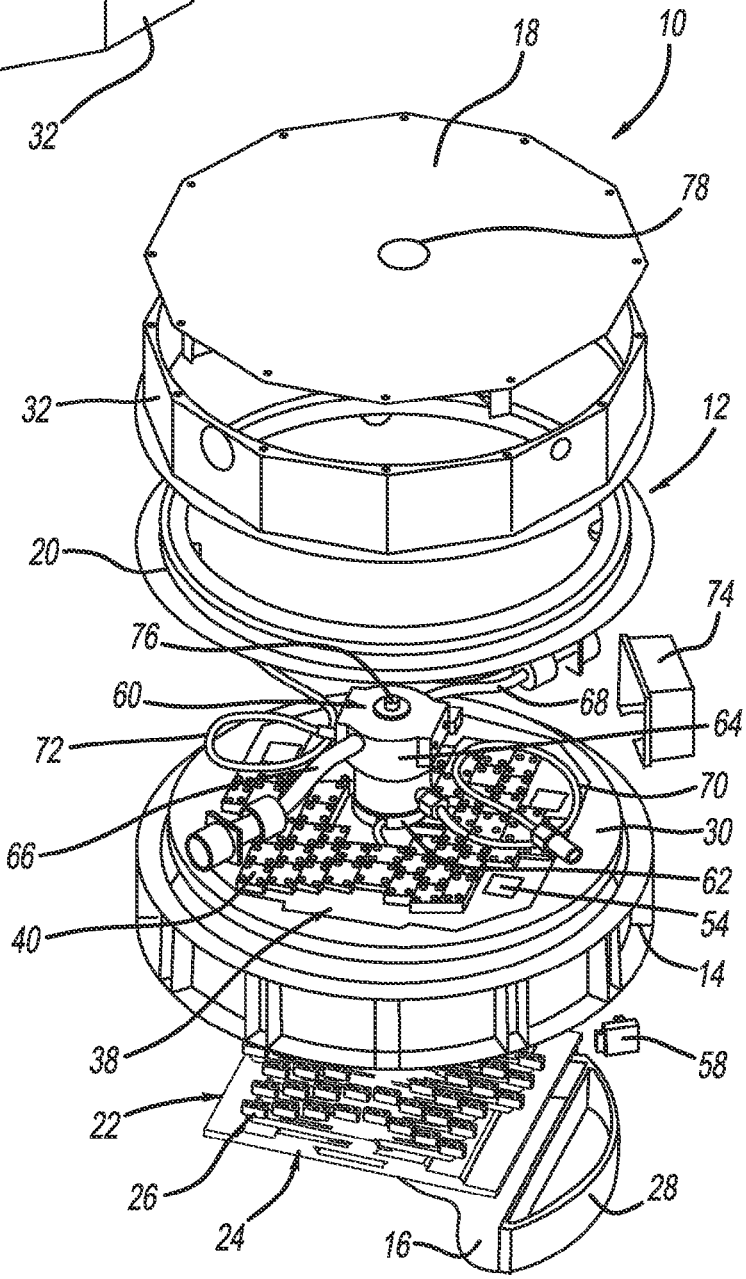
FIG. 2 is a bottom exploded view of the antenna shown in FIG. 1.

FIG. 1 is a top isometric view and FIG. 2 is a bottom exploded view of a hybrid electronic/mechanical scanning array antenna 10. As will be discussed in detail below, the antenna 10 provides mechanical scanning in an azimuth direction by rotating the antenna aperture and electrically scanning in an elevation direction through phase-weighted antenna elements so as to provide a relatively low cost and compact antenna suitable for airborne platforms and satellite communications. By providing mechanical scanning in the azimuth direction, the number of active phased array antenna elements requiring phase-weighted elements and amplifier elements is reduced. Although the discussion herein talks about the antenna 10 being for transmission purposes, those skilled in the art will readily recognize that the antenna 10 can be used for reception purposes also basically by reversing the orientation of the power amplifiers and replacing them with suitable low noise amplifiers.

Figure 3:
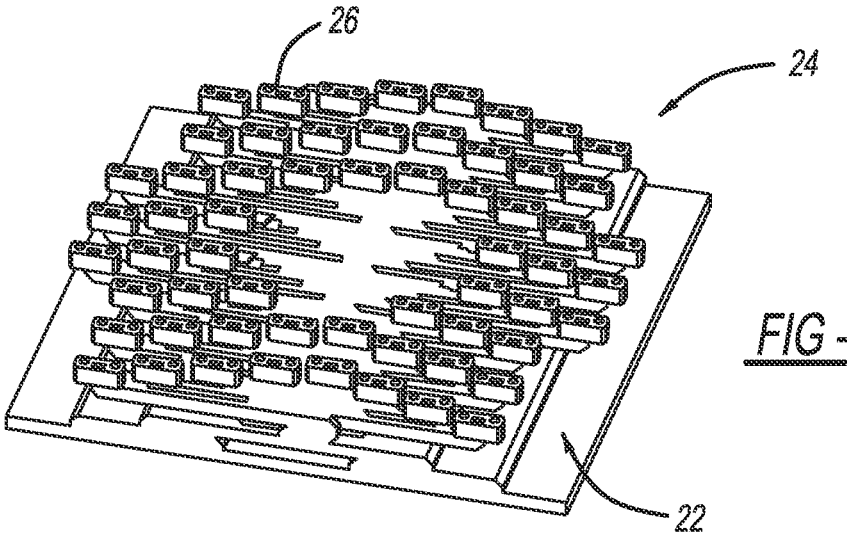
FIG. 3 is an isometric view of a waveguide fed slot array aperture separated from the antenna.

The antenna 10 includes an outer housing 12 having an upper cylindrical side wall 14, a lower cylindrical side wall 32, a top cover 16 and a closeout bottom cover 18 mounted together in any suitable manner, such as with glue, snap-fit assembly, etc. A circular bearing ring assembly 20 is mounted within the housing 12 and provides the bearings on which the antenna aperture is mechanically rotated in azimuth. A waveguide aperture 24 is positioned within the cover 16 and includes a waveguide fed slot array 22 having antenna slot antenna elements 26, where the waveguide aperture 24 is shown separated from the antenna 10 in FIG. 3. The waveguide fed slot array 22 provides low loss, excellent scanning capability and a low profile. However, other planar array elements could also be applicable. A meander-line polarizer 28 is also positioned within the cover 16 adjacent to the aperture 24 and converts the linearly polarized signals generated by the slot array 22 in the aperture 24 to circularly polarize signals suitable for satellite communications signals. The orientation and size of the waveguide aperture 24 is frequency dependent in that different size apertures are required for different frequencies.

The waveguide aperture 24 is mounted to a top surface of a circular heat sink mounting cold plate 30 positioned within the housing 12. As will be discussed in further detail below, the mounting plate 30 includes a configuration of flow channels therein that accept a cooling fluid, such as water, to cool the antenna electronics. A multi-layer circuit board 38 is mounted to an underside of the mounting plate 30 opposite to the waveguide aperture 24. A series of ring frame GaN solid state power amplifier (SSPA) modules 40 are fastened with electrical interconnects passing to and from the circuit board 38 opposite to the mounting plate 30. Each module 40 is associated with one of the slot elements 26 in the aperture 24 and defines one of the antenna elements that can be electronically steered through phase weighting. The circuit board 38 and the ring frame modules 40 are designed and integrated with the slot array 22 in such a way as to form a radiation pattern that can be scanned in elevation. In this non-limiting embodiment, there are sixty-four of the slot elements 26 and the modules 40 for a particular application. The discussion below of the other elements of the antenna 10 will directed to this number of antenna elements with the understanding that other applications may employ other numbers of antenna elements.

Figure 4:
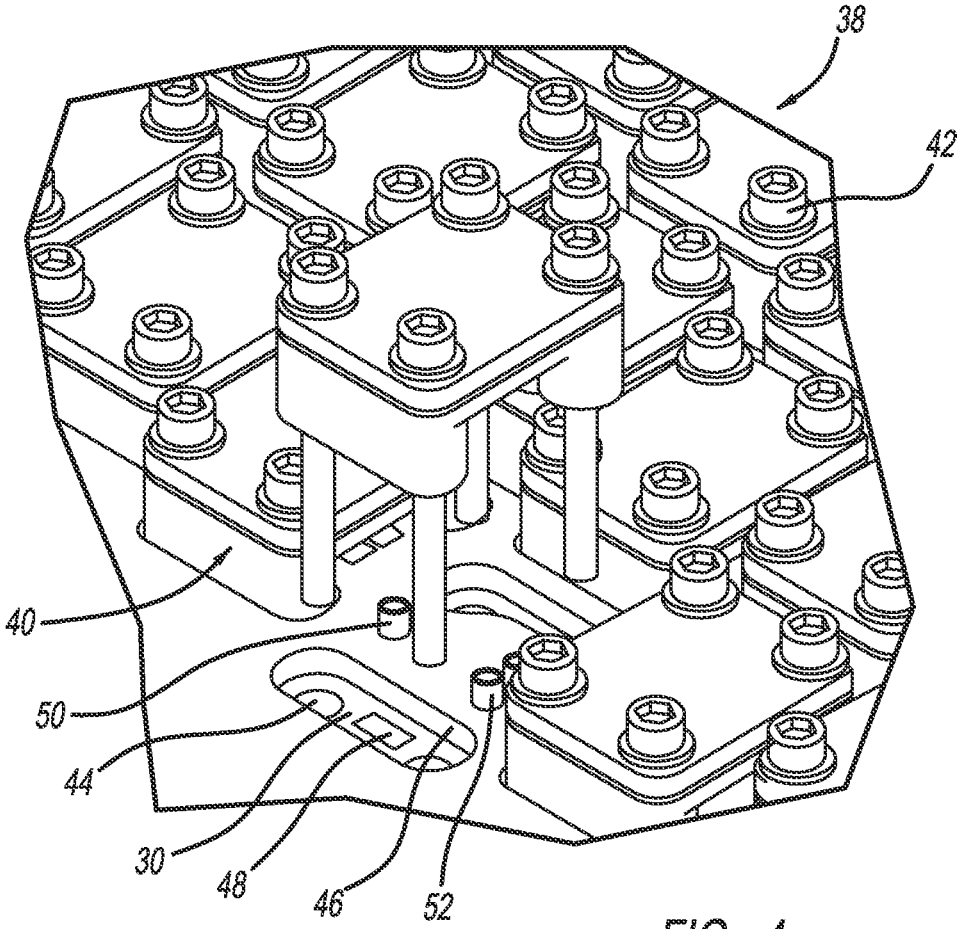
FIG. 4 is a cut-away isometric view of a portion of a circuit array of the antenna showing antenna element modules.

FIG. 4 is a cut-away isometric view showing a few of the modules 40, where one of the modules 40 is shown in a raised positioned from the circuit board 38. Each of the modules 40 is bolted to the mounting plate 30 by bolts 42 secured in threaded holes 44 in the mounting plate 30. The circuit board 38 includes a number of slots 46 that allow the bolts 42 to pass through the circuit board 38 and access the holes 44 in the mounting plate 30. The slots 46 allow metal-to-metal contact between the modules 40 and the mounting plate 30 for better heat removal. Further, the mounting plate 30 includes an RF signal channel 48 extending therethrough and aligned with the slot 46 for each of the modules 40 that allow the RF signal to be transmitted to pass through to the waveguide aperture 24. As will be discussed in further detail below, each of the modules 40 includes a driver amplifier and a high power amplifier. Each of the modules 40 also includes a single electrical connector 50 for the RF input signal and an electrical connector 52 for the DC bias signal for the amplifiers.

Four sixteen element SiGe beam forming network (BFN) circuits 54 are mounted to the circuit board 38 that provide the variable phase shifting for the phase weighting of the electronic scanning, as will be discussed in detail below. Further, a field programmable gate array (FPGA) circuit (not shown in FIG. 2) is also mounted to the circuit board 38 to provide control and timing signals, as will also be discussed in detail below.

The antenna 10 includes a cylindrical fluid RF DC rotary joint 60 including a rotor 62 that rotates and a stator 64 that does not rotate, where the stator 64 and the rotor 62 are generally concentric with each other in a stacked configuration and where the rotor 62 is coupled to the mounting plate 30. The rotary joint 60 allows RF, DC and digital signals to pass through, and also passes the cooling fluid that removes waste heat from the cold plate 30. An RF input connector 76 is located on the stator 64, on-axis with the rotary joint 60, and is accessible through an opening 78 in the closeout cover 18, where the RF signals provided to the connector 76 pass through the rotary joint 60 and feed the circuit board 38. A DC electrical harness 66 and a digital harness 68 extend through the housing wall 32 and are coupled to the stator 64. DC slip joints internal to the rotary joint 60 allow the electrical harnesses 66 and 68 to exit the rotor 62, pass through the mounting plate 30, and feed the circuit board 38 on the aperture side. Cooling fluid hoses 70 and 72 extend through the housing wall 32 and are coupled to the stator 64. The hose 72 receives the cooling fluid from, for example, a chiller (not shown), and directs the cooling fluid into the rotary joint 60 from the stator 64 to the rotor 62 and then to flow channels in the mounting plate 30. The heated cooling fluid flows from the flow channels within the mounting plate 30 to the rotor 62 and out of the rotary joint 60 through the hose 70. An azimuth drive motor actuator and encoder 74 rotates the cold plate 30 for the azimuth scanning and provides measurements as to how much rotation has occurred for accurate scanning. The rotating assembly is actuated by a spur gear connected to the motor actuator 74, however, can be replaced with a belt drive motor or by moving the ring frame modules 40 to be between the slot array 22 and the cold plate 30. Position and velocity telemetry is provided by an inertial measurement unit (IMU) 58 having GPS capability that is mounted to the housing 12.

Figure 5:
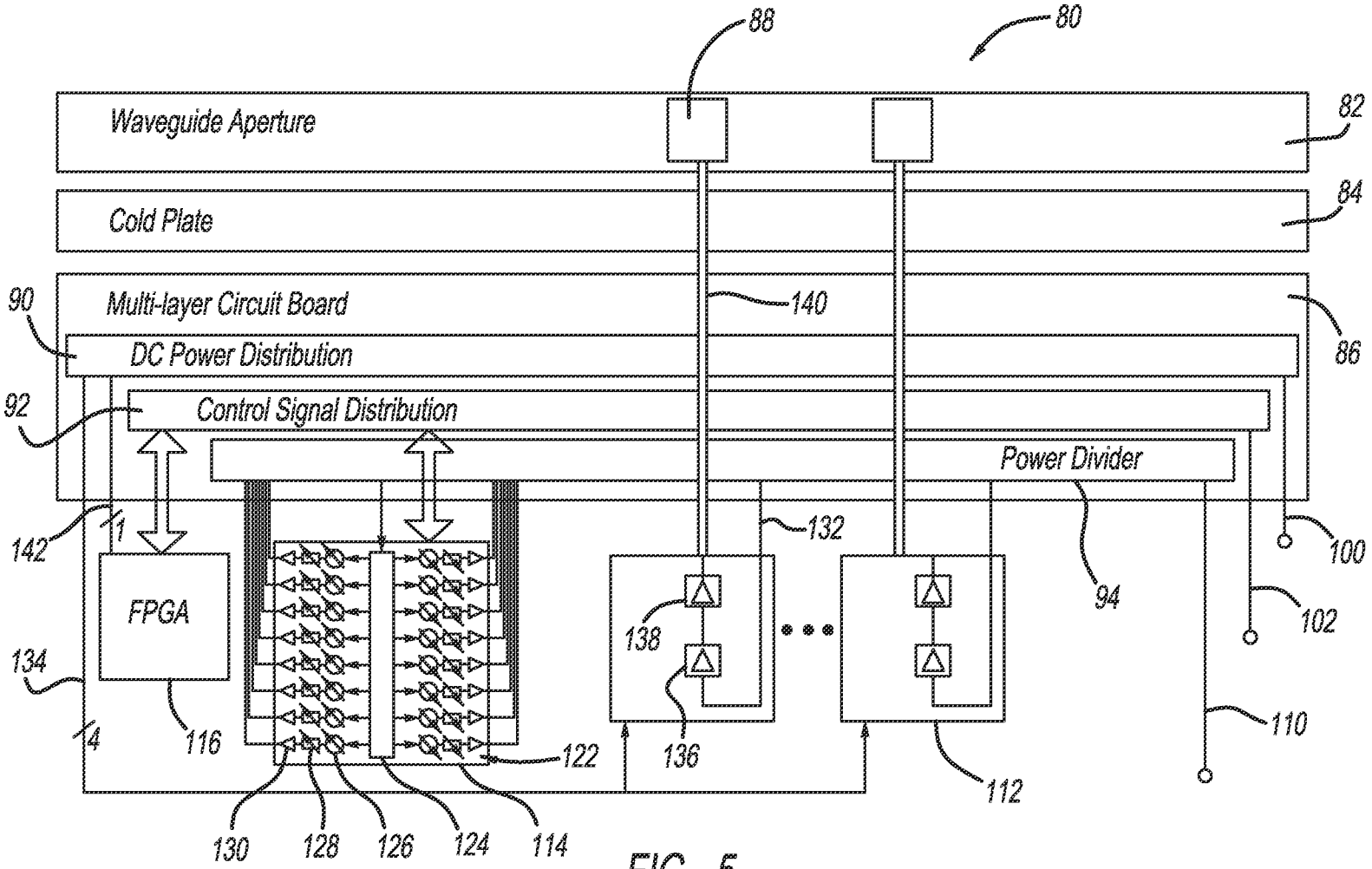
FIG. 5 is a block diagram of the hybrid electronic/mechanical scanning array antenna.

FIG. 5 is a schematic block diagram of an antenna array 80 including the elements discussed above for the antenna array 10. The antenna array 80 includes a waveguide radiating aperture 82 representing the waveguide aperture 24, a cold plate 84 representing the cold plate 30, and a multi-layer mixed signal printed circuit board 86 representing the circuit board 38. Two of the sixty-four slot elements 88, representing the slot elements 26, are shown in the radiating aperture 82. The circuit board 86 includes a DC power distribution layer 90, a control signal distribution layer 92 and a one-to-four RF power divider and RF distribution layer 94. The DC power distribution layer 90 receives a DC power signal on line 100, the control signal distribution layer 92 receives digital command and telemetric signals on line 102, and the RF signal to be transmitted is provided on line 110 to the power divider and RF distribution layer 94. The antenna array 80 also includes sixty-four ring frame amplifier modules 112 representing the modules 40, four sixteen element BFN circuits 114 representing the BFN circuits 54, and an FPGA circuit 116.

The RF signal on the line 110 is divided four times in the power divider and RF distribution layer 94 and each divided RF signal is sent to one of the four sixteen element BFN circuit 114. The signal sent to each BFN circuit 114 is power divided sixteen times by a power divider 124 and sent to sixteen separate channels 122 each including a variable phase shifter 126, a variable attenuator 128 and an amplifier 130. The phase shifter 126 provides the phase shift of the signals for the electronic beam steering in elevation and the amplifier 130 generally recovers the signal loss provided by the phase shifter 126 and the attenuator 128. The operation and control of the phase shifters in phased antenna arrays for electronic beam steering is well understood by those skilled in the art. Each of the sixteen signals from each of the BFN circuit 122 is routed back through the power divider and RF distribution layer 94 to be sent to one of the sixty-four ring frame modules 112 on line 132 representing the electrical connector 50. The modules 112 include a driver amplifier 136, such as a 0.2 W GaAs SSDA chip, and a high power amplifier 138, such as a 2-8 W GaN SSDA chip. A DC bias signal for the amplifiers 136 and 138 is provided on line 134 from the DC power distribution layer 90, and represents the electrical connector 52. The amplified RF signal is then sent through a waveguide channel 140 representing the signal channel 48 to be radiated by the slot 88. The FPGA circuit 116 receives a control signal from the DC power distribution layer 90 on line 142.

The foregoing discussion disclosed and describes merely exemplary embodiments of the present invention. One skilled in the art will readily recognize from such discussion and from the accompanying drawings and claims that various changes, modifications and variations can be made therein without departing from the spirit and scope of the invention as defined in the following claims.

What is claimed is:

1. A scanning array antenna comprising:

an outer housing;

a cold plate rotatably mounted within and relative to the outer housing, said cold plate including a top surface and a bottom surface;

a waveguide aperture including an array of antenna elements mounted to the top surface of the cold plate;

a multi-layer circuit board mounted to the bottom surface of the cold plate; and a plurality of amplifier modules mounted to the cold plate through the circuit board, said circuit board including a plurality of openings that allow the amplifier modules to be directly mounted to the cold plate through the circuit board, said cold plate including a plurality of RF signal channels that allow RF signals from the amplifier modules to travel through the cold plate to the antenna elements, wherein the plurality of amplifier modules are controlled to provide phase weighting for electronic signal scanning in an elevation direction and rotation of the cold plate allows signal scanning in an azimuth direction.

2. The antenna according to claim 1 wherein the array of antenna elements is a planar slot array.

3. The antenna according to claim 2 wherein the antenna elements are slot antenna elements.

4. The antenna according to claim 1 further comprising a plurality of beam forming network circuits that receive distributed RF signals from the circuit board and provide the phase-weighted signals to the amplifier modules.

5. The antenna according to claim 4 wherein the multi-layer circuit board includes a DC power distribution layer, a control signal distribution layer and a one-to-four RF power divider and RF distribution layer, said power divider and RF distribution layer providing the RF signals to the BFN circuits.

6. The antenna according to claim 1 further comprising a rotary joint mounted within the housing, said rotary joint including a stator and rotor, said rotor being mounted to the cold plate.

7. The antenna according to claim 6 further comprising a bearing assembly, said cold plate being mounted on the bearing assembly and said bearing assembly being rotated by a motor.

8. The antenna according to claim 6 further comprising cooling fluid hoses attached to the stator of the rotary joint and extending through the housing, wherein a cooling fluid enters the antenna through one the cooling fluid hoses, flows through the stator into the rotor and then into the cold plate where it is heated, and wherein the heated cooling fluid flows from the cold plate through the rotor, through the stator and then through another one of the cooling fluid hoses to exit the antenna.

9. The antenna according to claim 6 further comprising one or more electrical harnesses attached to the stator of the rotary joint and extending through the housing and an RF connector attached to the stator of the rotary joint and passing through a cover of the housing, said electrical harnesses providing electrical signal to the circuit board and said RF connector providing RF signals to the circuit board.

10. The antenna according to claim 1 wherein the plurality of amplifier modules each include a driver amplifier and a high power amplifier.

11. The antenna according to claim 1 wherein the array of antenna elements includes sixty-four elements and the plurality of amplifier modules is sixty-four amplifier modules.

12. The antenna according to claim 1 wherein the housing is cylindrical.

13. The antenna according to claim 1 wherein the amplifier modules are bolted to the cold plate.

14. The antenna according to claim 1 wherein the antenna is configured to be mounted within a skin of an airborne platform.

15. A scanning array antenna configured to be mounted within a skin of an airborne platform, said antenna comprising:

a cylindrical outer housing;

a circular cold plate rotatably mounted within and relative to the outer housing, said cold plate including cooling fluid flow channels and a top surface and a bottom surface;

a circular waveguide aperture including an array of antenna slot elements mounted to the top surface of the cold plate;

a multi-layer circuit board mounted to the bottom surface of the cold plate;

a rotary joint mounted within the housing, said rotary joint including a stator and rotor, said rotor being mounted to the cold plate;

cooling fluid hoses attached to the stator of the rotary joint and extending through the housing, wherein cooling fluid enters the antenna through one the cooling fluid hoses, flows through the stator into the rotor and then into the cold plate where it is heated, and wherein the heated cooling fluid flows from the cold plate through the rotor, through the stator and then through another one of the cooling fluid hoses to exit the antenna;

one or more electrical harnesses attached to the stator of the rotary joint and extending through the housing, said electrical harnesses providing electrical signals to the circuit board;

an RF connector attached to the stator of the rotary joint and passing through a cover of the housing, said RF connector providing RF signals to the circuit board; and a plurality of amplifier modules mounted to the cold plate through the circuit board, said circuit board including a plurality of openings that allow the amplifier modules to be directly mounted to the cold plate through the circuit board, said cold plate including a plurality of RF signal channels that allow RF signals from the amplifier modules to travel through the cold plate to the antenna elements, wherein the plurality of amplifier modules are controlled to provide phase-weighting for electronic signal scanning in an elevation direction and rotation of the cold plate allows signal scanning in an azimuth direction.

16. The antenna according to claim 15 further comprising a plurality of beam forming network circuits that receive distributed RF signals from the circuit board and provide the phase-weighted signals to the amplifier modules.

17. The antenna according to claim 15 wherein the multi-layer circuit board includes a DC power distribution layer, a control signal distribution layer and a one-to-four RF power divider and RF distribution layer, said power divider and RF distribution layer providing the RF signals to the BFN circuits.

18. The antenna according to claim 15 further comprising a bearing assembly, said cold plate being mounted on the bearing assembly and said bearing assembly being rotated by a motor.

19. The antenna according to claim 15 wherein the plurality of amplifier modules each include a driver amplifier and a high power amplifier.

20. The antenna according to claim 15 wherein the array of antenna elements includes sixty-four elements and the plurality of amplifier modules is sixty-four amplifier modules.

* * * * *